US006132246A

United States Patent [19]

Kodama

[11] Patent Number: 6,132,246

[45] Date of Patent: Oct. 17, 2000

[54] CONNECTOR TO BE INSERTED INTO A MOVABLE CONNECTOR

[75] Inventor: Shinji Kodama, Shizuoka, Japan

[73] Assignee: Yazaki Corporation, Tokyo, Japan

[21] Appl. No.: 09/222,728

[22] Filed: Dec. 29, 1998

[30] Foreign Application Priority Data

Jan. 13, 1998 [JP] Japan ..... 10-004938

[51] Int. Cl.[7] ..... H01R 13/73

[52] U.S. Cl. ..... 439/557; 439/701

[58] Field of Search ..... 439/557, 553, 439/554, 558, 555, 598, 701

[56] References Cited

U.S. PATENT DOCUMENTS

Re. 34,430 11/1993 Mosquera et al. ..... 439/557

3,753,212 8/1973 Yamada et al. ..... 439/557

4,731,925 3/1988 Tanishi et al. ..... 439/557

*Primary Examiner*—Hien Vu

*Attorney, Agent, or Firm*—Armstrong, Westerman, Hattori, McLeland & Naughton

[57] ABSTRACT

A connector to be inserted into a movable connector is provided. This connector has stopper protrusions on its housing main body, and the stopper protrusions are to be engaged with lock arms standing from the inner wall surfaces of the attachment slots formed in the frame of a movable connector. A pair of guide ribs are formed on both sides of each of the stopper protrusions so as to prevent displacement of the lock arms. The guide ribs are arranged in parallel with the insertion direction of the connector. After the connector is inserted into the attachment slots, the rear end surfaces of the guide ribs are situated on the same plane as the contact surface of the frame. With this structure, the connector can be prevented from slipping off the attachment slots of the movable connector even if external force larger than the insertion of force is exerted on the connector.

11 Claims, 4 Drawing Sheets

CONNECTOR TO BE INSERTED INTO A MOVABLE CONNECTOR

BACKGROUND OF THE INVENTION

1. Field of the Invention

The present invention relates to a connector to be inserted into a movable connector.

2. Description of the Related Art

Conventionally, there has been a rotatable connector 60 as shown in FIGS. 4 and 5.

The rotatable connector 60 comprises a flat frame 61, a pair of attachment slots 62 penetrating through both sides of the frame 61, and a cylindrical wall 65 extending rearward in the middle of the frame 61. A pair of lock arms 63 stands on the rear side of the inner surface of each of the attachment slots 62, while a pair of stoppers 64 facing to each other are formed on the front side. Flexible elastic arms 66 extending rearward are formed along the outer periphery of the cylindrical wall 65. A nut 67 is secured inside the cylindrical wall 65 on its rear side.

With a connector 70 being inserted into the attachment slots 62, stopper protrusions 72 formed on the housing main body 71 of the connector 70 are engaged with the lock arms 63, and a pair of guide ribs 73 formed on both sides of each of the stopper protrusions 72 are brought into contact with the stoppers 64, as shown in FIG. 6.

However, if external force F larger than necessary is inadvertently exerted in the direction of the arrow (shown in FIG. 6) after the insertion of the connector 70, the connector 70 moves even further into the attachment slots 62, and the lock arms 63 and/or the stopper protrusions 72 will be damaged, as shown in FIG. 7. Because of this, there is always a possibility that the connector 70 will slip off the attachment slots 62.

In FIG. 5, reference numeral 75 indicates the panel wall of a vehicle, and reference numeral 76 indicates a panel opening formed through the panel wall 75.

SUMMARY OF THE INVENTION

In view of the foregoing problems, the principal object of the present invention is to provide a connector which will not slip off the attachment slots of a movable connector, even if external force larger than the insertion force is exerted on the connector.

To achieve the above object, the present invention provides a connector which has stopper protrusions to be engaged with lock arms standing on the inner wall surfaces of the attachment slots of the frame of a movable connector, which is to be brought into contact with the panel wall of a vehicle. A pair of guide ribs are formed on both sides of each of the stopper protrusions are formed so as to prevent displacement of the lock arms. The guide ribs are arranged in parallel with the insertion direction of the connector. After the connector is inserted into the attachment slots, the rear end surfaces of the guide ribs are situated on the same plane as the contact surface of the frame.

With this structure, when the movable connector with the connector inserted therein is brought into contact with the panel wall, the rear end surfaces of the guide ribs and the contact surface of the frame are also brought into contact with the panel wall. Even if external force larger than the insertion force for the connector is exerted on the connector in a direction opposite to the insertion direction during the attachment operation of the movable connector to the panel wall, the external force acts not only on the lock arms engaged with the stopper protrusions, but also on the panel wall. Accordingly, no damage is caused to the stopper protrusion and/or the lock arms, and the connector can be prevented from slipping off the attachment slots of the movable connector. Thus, workability in the attachment operation can become considerably higher than in the prior art.

The above and other objects and features of the present invention will become more apparent from the following description taken in conjunction with the accompanying drawings.

DESCRIPTION OF THE PREFERRED EMBODIMENT

The following is a detailed description of the preferred embodiment of the present invention, with reference to the accompanying drawings.

Figure 1:
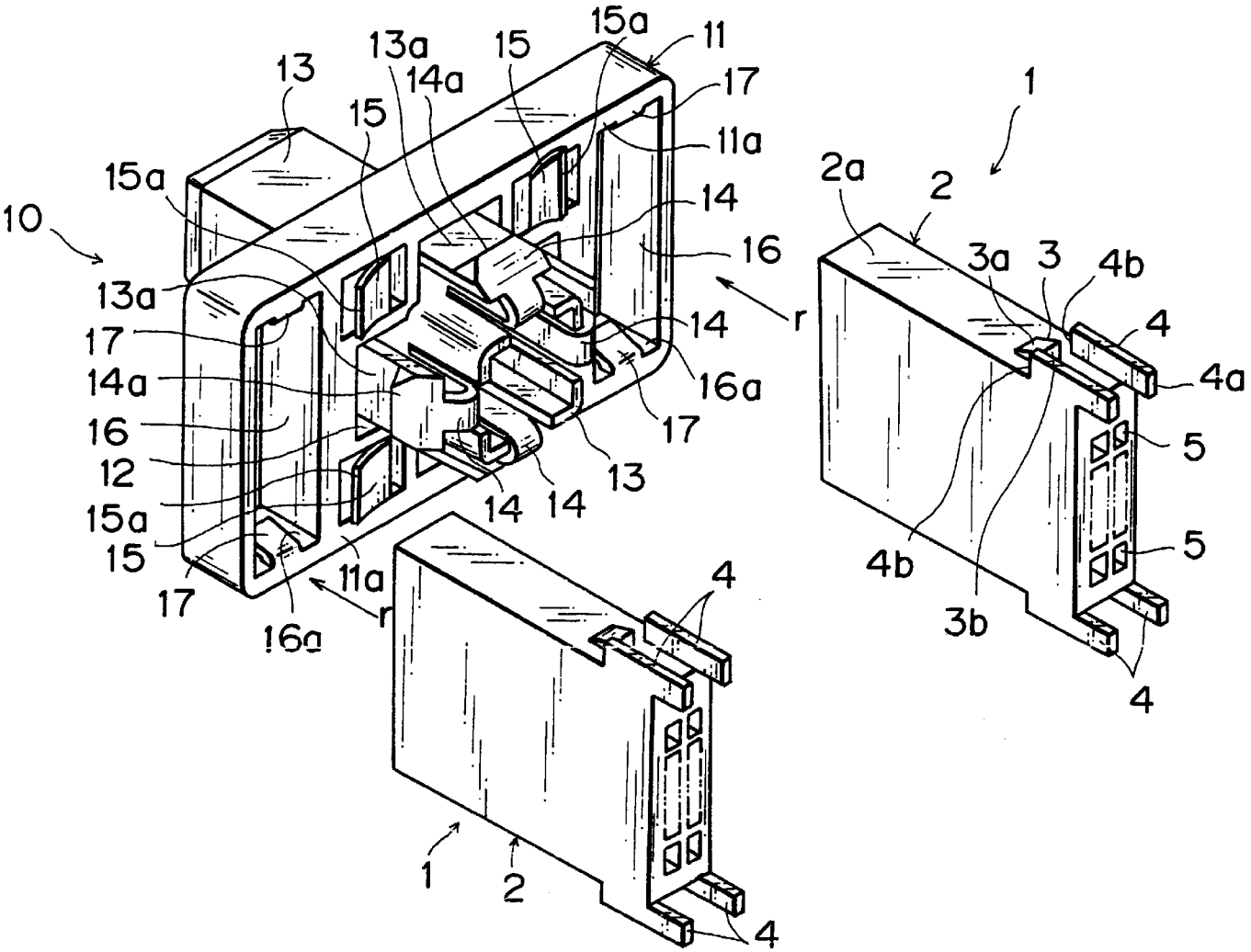
FIG. 1 is a perspective view of one embodiment of the connector to be inserted into a movable connector according to the present invention.
Figure 2:
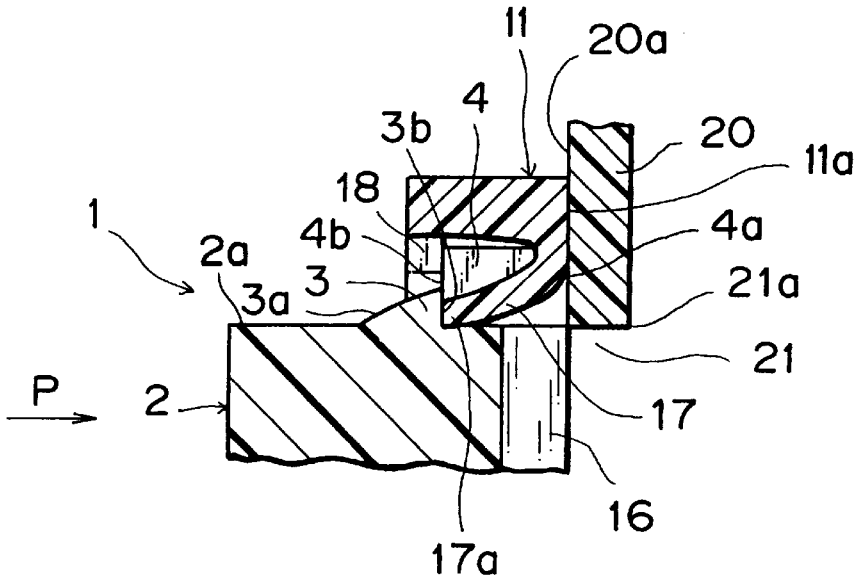
FIG. 2 is a cross sectional view of the movable connector with the connector inserted into a panel opening.
Figure 3:
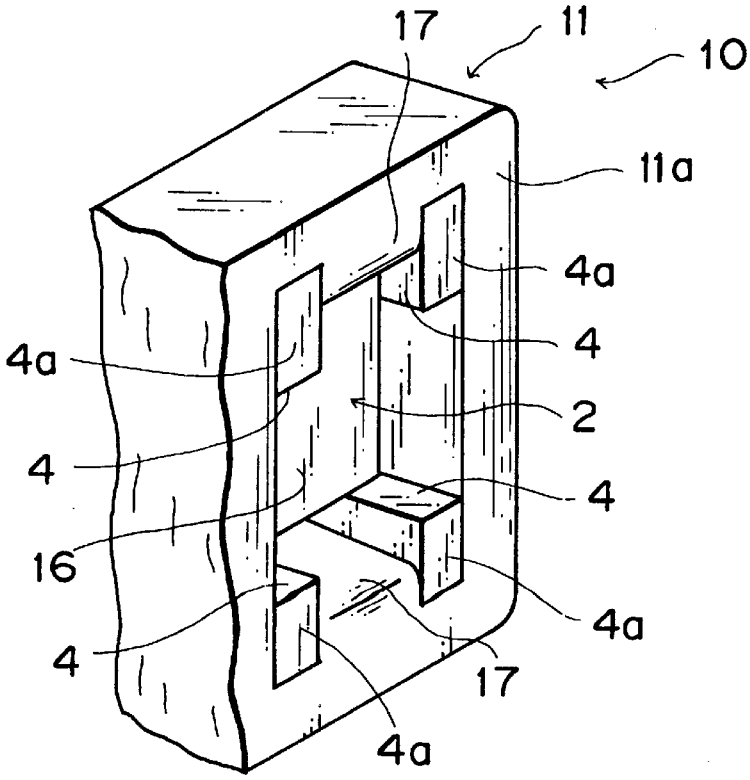
FIG. 3 is a perspective view of the connector inserted into the attachment slots of the movable connector.
Figure 4:
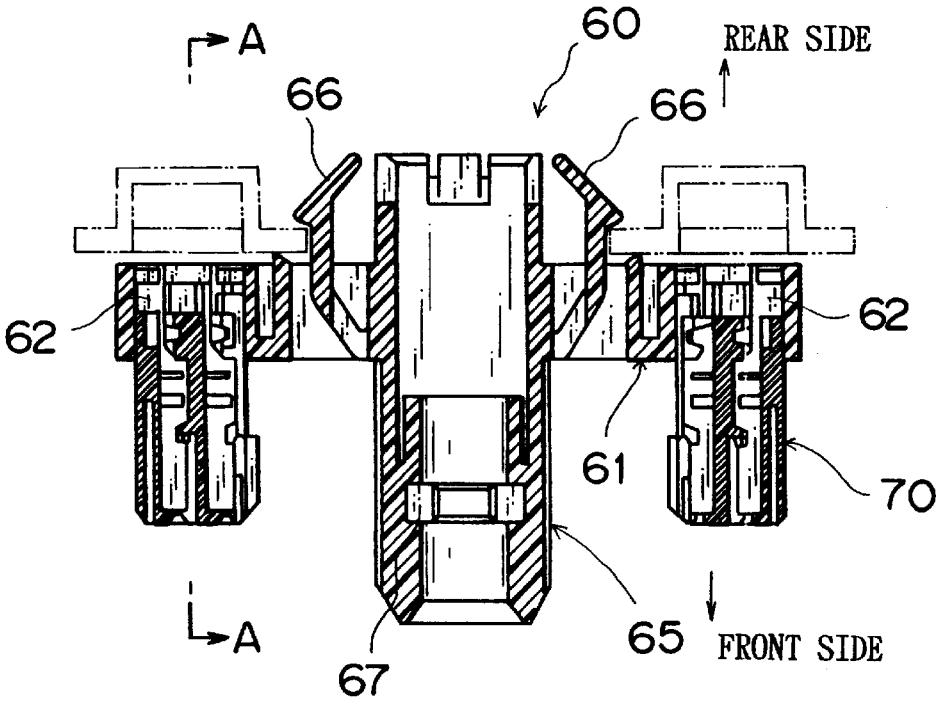
FIG. 4 PRIOR ART
FIG. 4 is a cross sectional view of a conventional movable connector.
Figure 5:
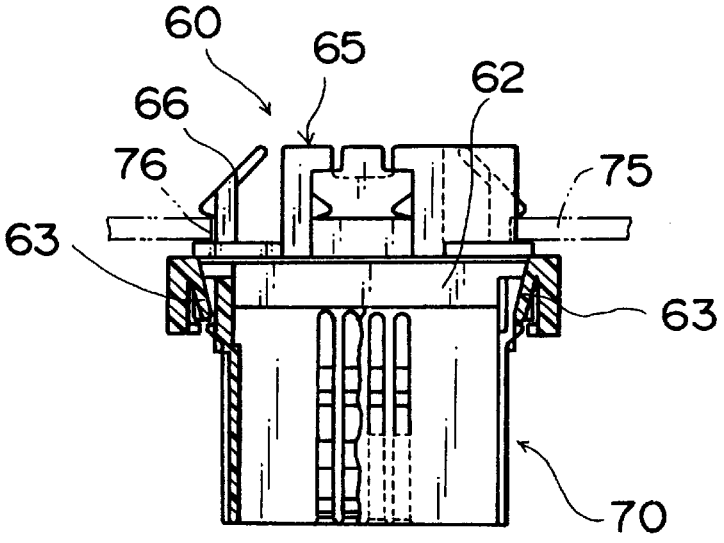
FIG. 5 PRIOR ART
FIG. 5 is a cross sectional view of FIG. 4 taken along the line A—A.
Figure 6:
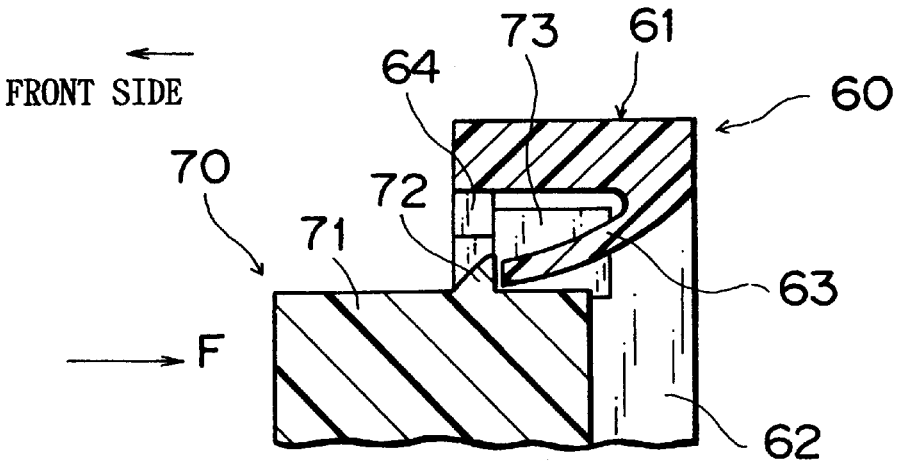
FIG. 6 PRIOR ART
FIG. 6 is an enlarged cross sectional view of FIG. 5.
Figure 7:
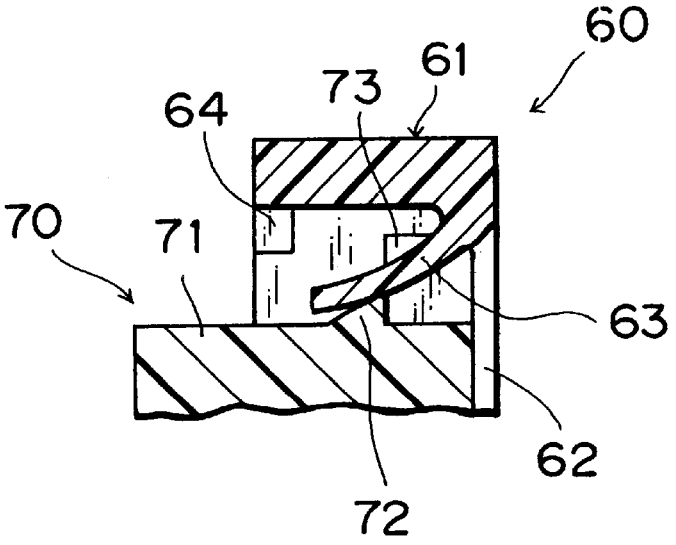
FIG. 7 PRIOR ART
FIG. 7 is a cross sectional view of a stopper protrusion damaged by the external force in the direction of the arrow in FIG. 5.

FIGS. 1 to 3 illustrate one embodiment of the connector to be inserted into a movable connector in accordance with the present invention. Like components are indicated by like reference numerals in the prior art and the following description.

In FIG. 1, a connector 1 comprises an insulated housing main body 2, stopper protrusions 3 standing on both side surfaces 2*a* of the housing main body 2, two pairs of guide ribs 4 formed on both sides of the stopper protrusions 3, and a plurality of terminal receiving chambers 5 penetrating through the housing main body 2. Each guide rib 4 is arranged in the insertion direction of the connector 1 (direction r).

A movable connector 10, into which the connector 1 is to be inserted, comprises a flat frame 11, a cylindrical wall 13 provided in the middle of the frame 11, and a pair of attachment slots 16 formed on both sides of the frame 11. The frame 11 is provided with an opening 12 in the middle, and the cylindrical wall 13, whose cross section is rectangular, is inserted into the opening 12. Each side wall 13*a* of the cylindrical wall 13 is provided with a pair of slits 13*b* on the rear side, and a first elastic arm 14 bent forward is disposed between each pair of slits 13*b*. Four second elastic arms 15 are arranged around the opening 12 of the frame The inner wall surface 16*a* of each of the attachment slots 16 is provided with a pair of lock arms 17 and a pair of stoppers 18. The lock arms 17 extend forward, and the stoppers 18 are arranged on the front side (see FIG. 2). The protrusion 14*a* of each first elastic arm 14 is engaged with the opening rim 21*a* of a panel opening 21 formed through a panel wall 20 of a vehicle (not shown), while the edge 15*a* of each second elastic arm 15 is brought into contact with the wall surface 2*a* of the panel wall 20.

With the protrusion 14*a* of each first elastic arm 14 being engaged with the opening rim 21*a* of the panel opening 21, the contact surface 11*a* of the frame 11 is brought into contact with the wall surface 20*a* of the panel wall 20. A nut (not shown) is fixed inside the cylindrical wall 13, and a bolt (not shown) standing from a base plate (not shown) of the meter unit is screwed into the nut.

With the connector 1 being inserted into the attachment slots 16 of the movable connector 10, as shown in FIG. 3, the rear end surfaces 4*a* of the guide ribs 4 of the housing main body 2 are on the same plane as the contact surface 11*a* of the frame 11. When the movable connector 10 with the connector 1 inserted is brought into contact with the panel wall 20, the contact surface 11*a* of the frame 11 and the rear end surfaces 4*a* of the guide ribs 4 come into contact with the wall surface 20*a* of the panel wall 20.

FIG. 2 illustrates a case where external force P larger than that required to release the stopper protrusions 3 from the edges 17*a* of the lock arms 17 is inadvertently exerted on the housing main body 2 in the direction of the arrow (i.e., a direction opposite to the engagement direction of the movable connector 10 and the connector 1). The external force P acts not only on the edges 17*a* of the lock arms 17 via the stopper protrusions 3, but also on the wall surface 20*a* of the panel wall 20 via the guide ribs 4 of the housing main body 2. In other words, the external force P does not act on one-point, but is dispersed. As a result, the force exerted on the lock arms 17 of the movable connector 10 and the stopper protrusions 3 of the housing main body 2 becomes smaller than in the prior art, which prevents the lock arms 17 and/or the stopper protrusions 3 from being damaged. Thus, the connector 1 can be kept from slipping off the movable connector 10.

As shown in FIGS. 1 to 3, the connector 1 is moved in the direction of the arrow (direction r) and inserted into the attachment slots 16 of the movable connector 10. The stopper protrusions 3 of the housing main body 2 is brought into contact with the lock arms 17 of the movable connector 10, and the lock arms 17 displace and bend along the tapered surfaces 3*a* of the stopper protrusions 3. When the front end surfaces 4*b* of the guide ribs 4 are brought into contact with the stoppers 18, the edges 17*a* of the lock arms 17, which have moved over the stopper protrusions 3, are engaged with the engaging surfaces 3*b* of the stopper protrusions 3. Here, the rear end surfaces 4*a* of the guide ribs 4 are on the same plane as the contact surface 11*a* of the frame 11. Thus, the connector 1 is inserted into and fixed in the movable connector 10.

The cylindrical wall 13 of the movable connector 10 is then inserted into the panel opening 21 of the panel wall 20, so that the protrusions 14*a* of the first elastic arms 14 are engaged with the opening rim 21*a* of the panel opening 21. After the engagement of the protrusions 14*a* with the panel opening 21, the rear end surfaces 4*a* of the guide ribs 4 and the contact surface 11*a* of the frame 11 are brought into contact with the wall surface 20*a* of the panel wall 20.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An engaging connector to be inserted into a movable connector comprising:

a housing main body;

stopper protrusions on a surface of the housing main body, said stopper protrusions positioned for engaging with lock arms formed on inner wall surfaces of attachment slots of the movable connector;

guide ribs formed on both sides of each of the stopper protrusions on the housing main body, the guide ribs, with front end and rear end surfaces, extending from said stopper protrusions to a point beyond the surface of the housing main body so the rear end surfaces of the guide ribs are not on the housing main body, and the guide ribs being arranged in parallel with an insertion direction of the engaging connector and when the front end surfaces of the guide ribs are brought into contact with stoppers on the movable connector, the rear end surfaces of the guide ribs are brought into a same plane as a contact surface of a frame of the movable connector and the lock arms of the moving connector engage said stopper protrusions, wherein the rear end surfaces of the guide ribs and the contact surface of the frame can both be brought into contact with a wall surface of a panel wall forming a structure which can prevent disengagement between the engaging connector and the movable connector and can also disperse external force placed on said engaging connector in a direction opposite to the insertion direction of the engaging connector to prevent damage to the engaging connector and the movable connector.

2. The engaging connector of claim 1 having two pairs of guide ribs.

3. The engaging connector of claim 1 having the guide ribs having a rectangular cross-section.

4. An engaging connector and a movable connector combination comprising:

the engaging connector for engagement with the movable connector, the engaging connector having, a housing main body;

stopper protrusions on a surface of the housing main body;

guide ribs formed on both sides of each of the stopper protrusions, the guide ribs having front end and rear end surfaces and being arranged in parallel with an insertion direction of the engaging connector;

the movable connector having, a frame having a contact surface suitable for contacting a wall surface of a panel wall, attachment slots in the frame having, inner wall surfaces, lock arms formed on the inner wall surfaces for engaging said stopper protrusions of said engaging connector, stoppers formed on the inner wall surfaces for engaging said guide ribs, the stoppers positioned so that when said front end surfaces of said guide ribs are brought into contact with the stoppers, said rear end surfaces of said guide ribs are brought into a same plane as said contact surface of the frame of the movable connector and the lock arms engage said stopper protrusions, wherein the rear end surfaces of the guide ribs and the contact surface of the frame can both be brought into contact with the wall surface of the panel wall forming a structure which can prevent disengagement between the engaging connector and the movable connector and can also disperse external force placed on said engaging connector in a direction opposite to the insertion direction of the engaging connector to prevent damage to the engaging connector and the movable connector.

5. The engaging connector and the movable connector combination of claim 4 having two pairs of guide ribs.

6. The engaging connector and the movable connector combination of claim 4, wherein the guide ribs extend from the stopper protrusions to a point beyond the surface of the housing main body so the rear end surfaces are not on the housing main body.

7. The engaging connector and the movable connector combination of claim 4 having the guide ribs having a rectangular cross-section.

8. An engaging connector, a movable connector, and a panel wall assembly comprising:

the engaging connector for engagement with the movable connector, the engaging connector having, a housing main body;

stopper protrusions on a surface of the housing main body;

guide ribs formed on both sides of each of the stopper protrusions, the guide ribs having front end and rear end surfaces and being arranged in parallel with an insertion direction of the engaging connector;

the movable connector having, a frame having a contact surface, attachment slots in the frame having, inner wall surfaces, lock arms formed on the inner wall surfaces for engaging said stopper protrusions of said engaging connector, stoppers formed on the inner wall surfaces for engaging said guide ribs, the stoppers positioned so that when said front end surfaces of said guide ribs are brought into contact with the stoppers, said rear end surfaces of said guide ribs are brought into a same plane as said contact surface of the frame of the movable connector and the lock arms engage said stopper protrusions; and a panel wall having a wall surface to be contacted with the contact surface of the frame, wherein the rear end surfaces of the guide ribs and the contact surface of the frame can both be brought into contact with the wall surface of the panel wall forming a structure which can prevent disengagement between the engaging connector and the movable connector and can also disperse external force placed on said engaging connector in a direction opposite to the insertion direction of the engaging connector to prevent damage to the engaging connector and the movable connector.

9. The engaging connector, the movable connector, and the panel wall assembly of claim 8 having two pairs of guide ribs.

10. The engaging connector, the movable connector, and the panel wall assembly of claim 8, wherein the guide ribs extend from the stopper protrusions to a point beyond the surface of the housing main body so the rear end surfaces are not on the housing main body.

11. The engaging connector, the movable connector, and the panel wall assembly of claim 8 having the guide ribs having a rectangular cross-section.

* * * * *